United States Patent [19]

Beacom

[11] 4,297,963

[45] Nov. 3, 1981

[54] MOORING DEVICE

[76] Inventor: Keith I. Beacom, P.O. Box 178, Huntsville, Ontario, Canada, P0A 1K0

[21] Appl. No.: 16,800

[22] Filed: Mar. 2, 1979

[51] Int. Cl.[3] ..... B63B 21/00

[52] U.S. Cl. ..... 114/230; 410/116; 114/218

[58] Field of Search ..... 114/218, 230; 280/179 R, 179 A; 24/201 A, 242; 410/104, 105, 112, 113, 115, 116, 10

[56] References Cited

U.S. PATENT DOCUMENTS

| | | | |
|---|---|---|---|
| 849,023 | 4/1907 | Sargent | 410/116 |
| 1,733,269 | 10/1929 | Mauk | 410/10 |
| 1,934,697 | 11/1933 | Butterworth | 410/10 |
| 2,688,289 | 9/1954 | Sterling | 280/179 R X |
| 3,381,925 | 5/1968 | Higuchi | 280/179 R X |
| 3,473,505 | 10/1969 | Brown | 114/218 X |
| 3,597,808 | 10/1971 | Johnson | 114/218 X |

*Primary Examiner*—Trygve M. Blix
*Assistant Examiner*—D. W. Keen
*Attorney, Agent, or Firm*—Berman, Aisenberg & Platt

[57] ABSTRACT

A device for example for securing a boat to a dock having spaced boards. The device comprises a body having a shaft and an elongated head secured transversely to one end thereof. A plate is mounted on the shaft for slidable movement thereon towards and away from the head with its plane parallel to the head, to provide an adjustable but uniform space between corresponding points on confronting surfaces of the head and the plate. These surfaces, during operation of the device act to grip therebetween planking of the dock. A spring is associated with the shaft and plate to urge the plate towards the head as this space is increased from a minimum value. The device further comprises a ring to which a line from the boat may be secured. This device greatly facilitates mooring a boat or the like to a dock or similar anchor structure in that the device, to which a line from the boat has been attached, need merely have its head passed longitudinally between adjacent, spaced boards of the dock against the urging of the spring, and its body then rotated so that its head is transversely located with respect to that space. The device thereby grips between the confronting surfaces of the head and plate these boards of the dock.

8 Claims, 4 Drawing Figures

MOORING DEVICE

BACKGROUND OF THE INVENTION

This invention relates to a securing device for boats, airplanes and the like, and more particularly relates to a device which, when secured to a line from such boat or other object securely grips a dock of standard construction with spaced decking, or the like.

It is common to moor boats and other devices by attaching lines secured thereto to mooring devices such as chocks secured to docks, or to tie the lines to rings similarly secured to the docks. While experienced boaters can effect such moorings with speed and efficiency, this is a time-consuming task for the average boater. Moreover, oftentimes the average boater ties the rope line from the boat to the dock ring insecurely so that the boat may break free from its mooring under wind or wave action or, at the other extreme, the rope line is tied so that it becomes difficult to undo the rope from its mooring.

As solutions to such problems, there have been numerous patented proposals directed towards the design of fixtures to be permanently attached to docks, to which cooperating mating attachments must be secured to the line from the boat (see for example Brown, U.S. Pat. No. 3,473,505, issued Oct. 21, 1969). While many such solutions are practical, in some instances it may not be desired to attach such a fixture to one's dock, or else the attachment to the line may be useless on another dock where there is not a cooperating fixture mounted.

Canadian Pat. No. 511,725 of Waespi, issued Apr. 12, 1955 describes and illustrates a stretcher and quick release clamp for cables which comprises a rod with fins at one end, attached to a cable end, which rod releasably passes through a hole in a cam plate secured to another cable end. The fins coincide and pass through recesses in the plate hole when the clamp is engaged or released, but otherwise when the clamp is in secured position, are urged against the bearing surface of the cam plate to securely engage the respective cable ends.

A further patent of general background interest is Canadian Pat. No. 751,251 of Preziosi, issued Aug. 10, 1965 which describes and illustrates a fastener for panels comprising a string urged stud mounted stud mounted in a receptacle over which panel apertures are fitted. This device however would be completely unsuitable for use as a securing device for mooring a boat or the like to the planks of a dock.

SUMMARY OF THE INVENTION

In accordance with the present invention, there is provided a device for securing or mooring boats, airplanes and the like to an anchor structure such as a dock having spaced decking elements of generally uniform thickness, the device having a body with a shaft and an elongated head secured transversely to one end thereof. The width of this head is less than the distance between adjacent decking elements. A plate is mounted on the shaft for slidable movement thereon towards and away from the head with its plane parallel to the head to provide an adjustable but uniform between corresponding points on confronting surfaces of the head and the plate. These confronting surfaces, during operation, act to grip therebetween the adjacent decking elements. A biasing means such as a compression spring is associated with the shaft and plate to urge the plate towards the head as this space is increased from a minimum value. A means to which a line may be secured, such as a ring, is also secured to the device.

Such a device is attached to the line from a boat, plane or the like, and may be releasably secured to the anchor structure by passing the head longitudinally through the space between the adjacent decking elements against the urging of the biasing means, and then rotating the body so that the head is transversely located with respect to that space and so that adjacent elements are gripped under bias between confronting surfaces of the head and plate.

In a preferred construction, the body of the device is rotatable with respect to the plate mounted thereon about an axis perpendicular to the plane of the plate, and the body of the device is in the form of a T-bar of uniform cross-section and integral construction. Where the biasing means is a compression spring, the compression spring is preferably mounted circumscribing the shaft of the body between a stop, adjustably secured near the free end of the shaft, and the slidable plate. It will be appreciated that when the mooring line or lines of a boat or float plane have such devices secured thereto, they may be securely moored to docks of standard wooden construction, where the decking is spaced for example three-eighth inches apart. When being secured to such a dock, the head of the device is simply depressed through the slot between adjacent boards in the decking, turned ninety degrees and released. The spring on the shaft forces the plate downward on the top of the dock and at the same time draws the head of the body upwards. To release the device from the dock a simple turn of ninety degrees with downward pressure, to align the head of the body with the slot between the adjacent boards and withdrawal of the device is all that is required.

BRIEF DESCRIPTION OF THE DRAWINGS

Other objects and advantages of the invention will become apparent upon reading the following detailed description and upon referring to the drawings in which:

FIGS. 2, 3 and 4 are schematic representations of the steps in securing this device to the spaced planks of a dock or the like.

In the drawings, similar features have been given similar reference numerals.

While the device of this invention has been described as a mooring device for boats or float planes, to secure them to docks, it is not intended to limit the defined scope of the present invention to such applications. Indeed, it is envisaged by the inventor that this device would have application in any situation and for any purpose where it is desired to attach a line or cable quickly and simply to an anchor structure having appropriately spaced elements of suitable thickness. It is thus intended to cover all alternatives, modifications and equivalents as may be included within the spirit and scope of the invention as defined by the appended claims.

DETAILED DESCRIPTION OF THE INVENTION

Figure 1:
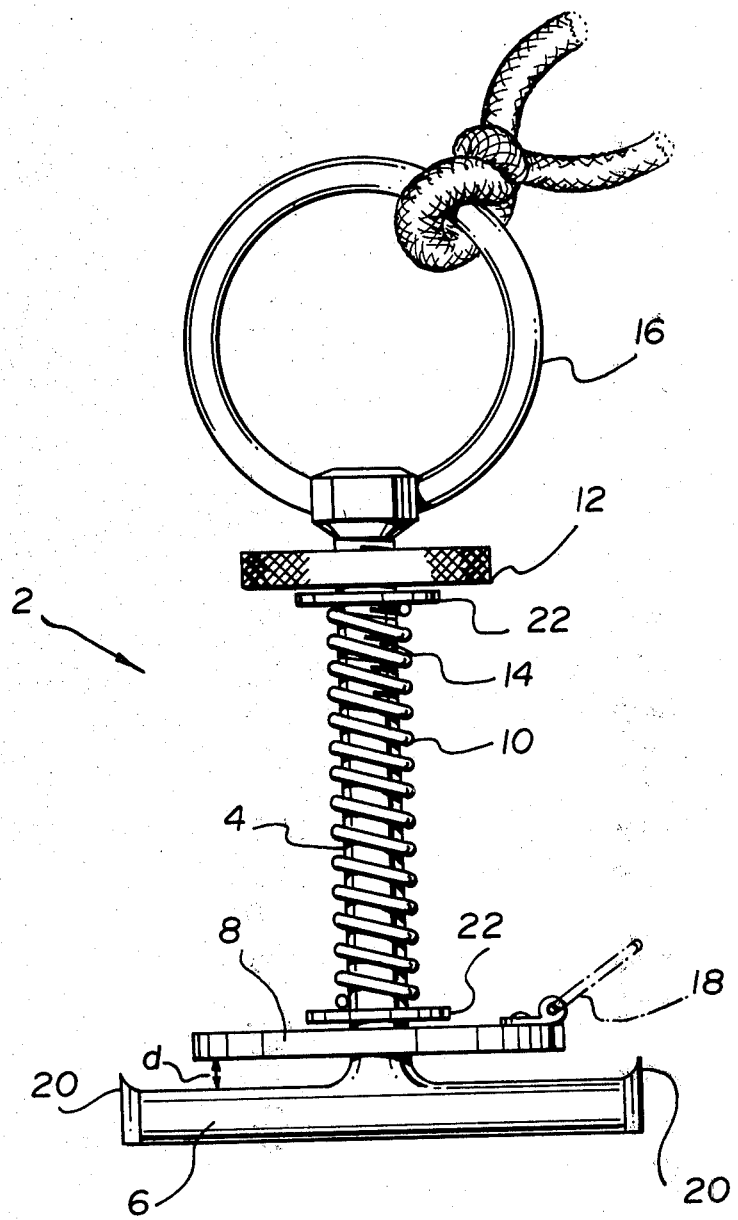
FIG. 1 is a perspective view from the side of a securing device according to the present invention.

Turning to FIG. 1, there is shown a securing device which may be used, for example, as a docking pin, having a body 2 made up of shaft 4 and elongated head 6. The body 2 is in the form of a "T-bar".

Plate 8 is slidably mounted on shaft 4 with its plane parallel to head 6 to provide an adjustable, uniform space "d" between confronting surfaces of the head and the plate. Body 2 is rotatable with respect to plate 8 mounted thereon about an axis perpendicular to the plane of the plate. A biasing means being compression spring 10 is positioned circumscribing the shaft 4, and is located between plate 8 and adjustment means 12, the latter being in the form of a knurled nut adjustably positionable on shaft 4 near its free end on threads 14. Tension on the spring is adjustable by moving adjustment means 12 so that an appropriate amount of pressure for various thicknesses of decking may be achieved. Ring 16 is secured to the free end of shaft 4, to which ring a line from the boat or the like may be tied. As shown in phantom in FIG. 1, a secondary ring 18 may be provided if required.

Head 6 may be provided with points 20 extending into the space between plate 8 and head 6 to assist the device when gripping for example the planks of a wooden dock. Washers 22 are provided on shaft 4, against which the ends of compression spring 10 may bear during operation.

Figure 2:
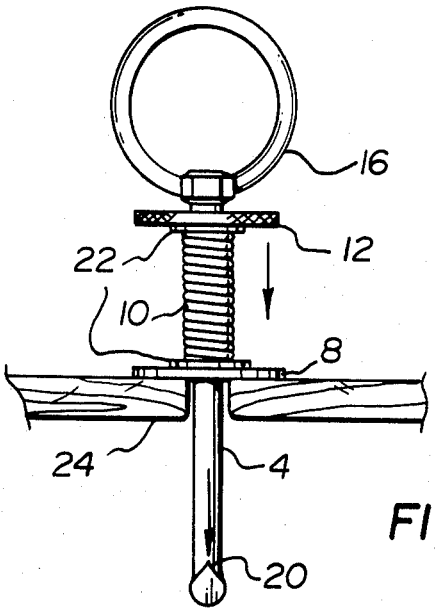
Figure 3:
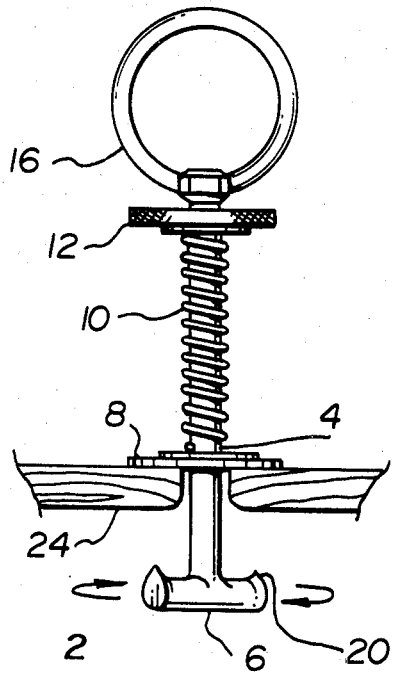
Figure 4:
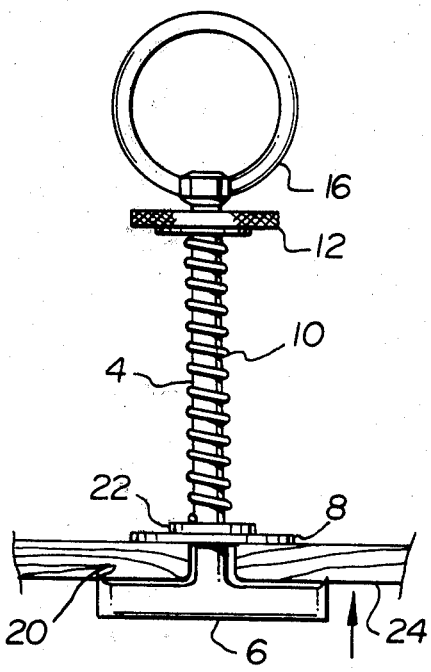

In operation, as illustrated in FIGS. 2, 3 and 4, the device, to which for example the rope from a boat has been attached at ring 16, is positioned over the space between adjacent planks 24 in a dock with its head 6 aligned therewith. The body 2 is then depressed against the bias of spring 10 (FIG. 2) so that the plate 8 bears against the planks 24 of the deck and head 6 passes downwardly through the space between these planks. The body is then rotated about ninety degrees (FIG. 3) and the device is then released (FIG. 4) so that adjacent planks 24 are gripped under bias between the confronting surfaces of head 6 and plate 8. Assuming the adjustment means 12 has been set to provide sufficient bias in this final position, the device will securely hold the attached line and boat to the dock.

To release the device from the dock, a simple turn of ninety degrees with downward pressure, reversing the steps of FIGS. 2 to 4, is all that is required.

Thus it is apparent that there has been provided in accordance with the invention a device for securing boats and the like to a stationary structure that fully satisfies the objects, aims and advantages set forth above. While the invention has been described in conjunction with the embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim as my invention:

1. A securing device for a dock or the like having spaced decking elements of uniform thickness comprising:

a body of uniform cross-section in rigid T-bar form, having a shaft and an elongated head secured transversely to one end thereof, the head being sufficiently narrow to fit between adjacent elements;

a flat plate mounted on the shaft for slideable movement thereon toward and away from the head;

biasing means associated with the shaft and plate to urge the plate toward the head; and means for securing a line.

2. A securing device for a dock or the like having spaced decking elements of uniform thickness comprising:

a body in rigid T-bar form, having a shaft and an elongated head secured transversely to one end thereof, the head being sufficiently narrow to fit between adjacent elements and having secured thereto at least a pair of points which project therefrom in the same direction as the shaft;

a flat plate mounted on the shaft for slideable movement thereon toward and away from the head;

biasing means associated with the shaft and plate to urge the plate toward the head; and means to secure a line.

3. A securing device according to claim 1 or 2, wherein the body of the device is rotatable with respect to the plate mounted thereon about an axis perpendicular to the plane of the plate.

4. A securing device according to claim 1 or 2, wherein the body is of integral construction.

5. A securing device according to claim 1 or 2, wherein the biasing means comprises a compression spring circumscribing the shaft between a stop means secured to the shaft at a distance from the plate at the free end of the shaft and the plate.

6. A securing device according to claim 5, wherein the stop means is at a position which is adjustable on the shaft, whereby force exerted by the spring on the plate and body is adjustable.

7. A securing device according to claim 6, wherein the stop means is a nut adjustably secured to a threaded portion of the shaft.

8. A device according to claim 1 or 2, wherein the means for securing a line is secured to the shaft at the end remote from that of the head.

* * * * *